US006687940B1

(12) United States Patent
Gross et al.

(10) Patent No.: US 6,687,940 B1
(45) Date of Patent: Feb. 10, 2004

(54) TOOTHBRUSH

(75) Inventors: Peter Gross, Sempach (CH); Peter Waldispuhl, Triengen (CH)

(73) Assignee: Trisa Holding AG, Triengen (CH)

( * ) Notice: Subject to any disclaimer, the term of this patent is extended or adjusted under 35 U.S.C. 154(b) by 0 days.

(21) Appl. No.: 09/807,115

(22) PCT Filed: May 20, 1999

(86) PCT No.: PCT/CH99/00217

§ 371 (c)(1),
(2), (4) Date: May 21, 2001

(87) PCT Pub. No.: WO00/21405

PCT Pub. Date: Apr. 20, 2000

(30) Foreign Application Priority Data

Oct. 8, 1998 (DE) ..... 298 17 994 U

(51) Int. Cl.[7] ..... A46B 5/02
(52) U.S. Cl. ..... 15/167.1; 15/143.1; 132/311
(58) Field of Search ..... 15/143.1, 167.1; 132/308, 311; 401/6, 183–185, 195

(56) References Cited

U.S. PATENT DOCUMENTS

| | | | | | |
|---|---|---|---|---|---|
| 1,007,042 | A | * | 10/1911 | Mosby | 132/311 X |
| 1,211,468 | A | * | 1/1917 | McLean | 15/143.1 X |
| 1,364,188 | A | * | 1/1921 | Draenert | 132/311 X |
| 1,549,473 | A | * | 8/1925 | Fairbanks | 15/167.1 X |
| 1,636,836 | A | * | 7/1927 | Read | 15/167.1 X |
| 2,317,123 | A | * | 4/1943 | Warp | 15/167.1 X |
| 2,813,290 | A | * | 11/1957 | Aschenbach | 401/184 |
| 3,129,449 | A | * | 4/1964 | Cyzer | 15/167.1 X |
| 3,937,235 | A | * | 2/1976 | Broughton | 132/308 |
| 4,175,879 | A | * | 11/1979 | Molinari | 401/287 |
| 4,583,563 | A | * | 4/1986 | Turner | 132/311 |
| 5,305,490 | A | * | 4/1994 | Lundgren | 15/167.1 |
| 5,339,482 | A | | 8/1994 | Desimone et al. | 15/167.1 |
| 5,372,501 | A | * | 12/1994 | Shalvi | 433/32 |
| 5,398,369 | A | | 3/1995 | Heinzelman et al. | 15/167.1 |
| 5,599,126 | A | * | 2/1997 | Hough | 401/184 |
| 5,622,195 | A | * | 4/1997 | Lee | 132/311 X |
| 5,781,958 | A | * | 7/1998 | Meessmann et al. | 15/167.1 |
| 5,845,358 | A | * | 12/1998 | Woloch | 15/167.1 X |
| 5,887,601 | A | * | 3/1999 | King | 132/311 |
| 6,000,410 | A | * | 12/1999 | Tortorice | 132/308 |

FOREIGN PATENT DOCUMENTS

| | | | | |
|---|---|---|---|---|
| CH | 615329 | * | 1/1980 | |
| DE | 29508990 | * | 8/1995 | |
| DE | 29709359 | * | 7/1997 | |
| EP | 303385 | * | 2/1989 | 15/167.1 |
| GB | 2236071 | * | 3/1991 | |
| JP | 6-245815 | * | 9/1994 | |
| SU | 1783977 | * | 12/1992 | |
| WO | 84/01700 | * | 5/1984 | 15/167.1 |
| WO | 97/29663 | * | 8/1997 | |

* cited by examiner

*Primary Examiner*—Mark Spisich
(74) *Attorney, Agent, or Firm*—Oliff & Berridge, PLC

(57) ABSTRACT

The invention comprises a toothbrush having improved manipulative and aesthetic features. The toothbrush includes a joined two-piece construction having a hollow or tubular interior cavity, and wherein the two pieces may be of differing configurations, differing plastic material, differing colors, partially or wholly translucent, and wherein ornamental objects may occupy the cavity when the toothbrush includes transparent portions. The handle also may include soft protuberances to facilitate gripping the toothbrush.

24 Claims, 3 Drawing Sheets

1
2
3
4
5
6
7
8
9
L
A
B
C

1'
L
2
3
4
6
7
9
11
12
14
15
17

1"
3
4
6
7
8
10
11
12
13
20
21
22
24
25
26
27
30

TOOTHBRUSH

The invention relates to a toothbrush having unique manipulative and aesthetic features.

BACKGROUND OF THE INVENTION

Toothbrushes are known in a wide range of different configurations. Conventional toothbrush handles are often difficult to handle, particular when one's hands are wet. In particular, users who have trouble with their joints often find it difficult to execute reliably and correctly the movements which are necessary for teeth cleaning.

BRIEF SUMMARY OF THE INVENTION

The object of the present invention is to provide an aesthetically pleasing toothbrush which allows improved handling and can be produced cost-effectively.

This object is achieved according to the invention by a toothbrush having the features set forth hereinafter and as illustrated.

Since the toothbrush handle is subdivided, over at least part of its length, into two parts which extend in the longitudinal direction of the toothbrush, are connected to one another and, together, enclose a cavity, the handle may be of relatively wide configuration, which results in a better grip without the toothbrush becoming too unwieldy.

Preferred further configurations of the toothbrush according to the invention in which the grip is additionally improved and/or a particularly aesthetically pleasing effect is achieved from the provision of transparent and internally decorative portion of the toothbrush, among other aspects.

BRIEF DESCRIPTION OF THE DRAWINGS

The invention is explained in more detail hereinbelow with reference to the several drawings, in which.

DETAILED DESCRIPTION OF THE PREFERRED EMBODIMENT

Figures 1, 2, 3, 4, 5, 6:
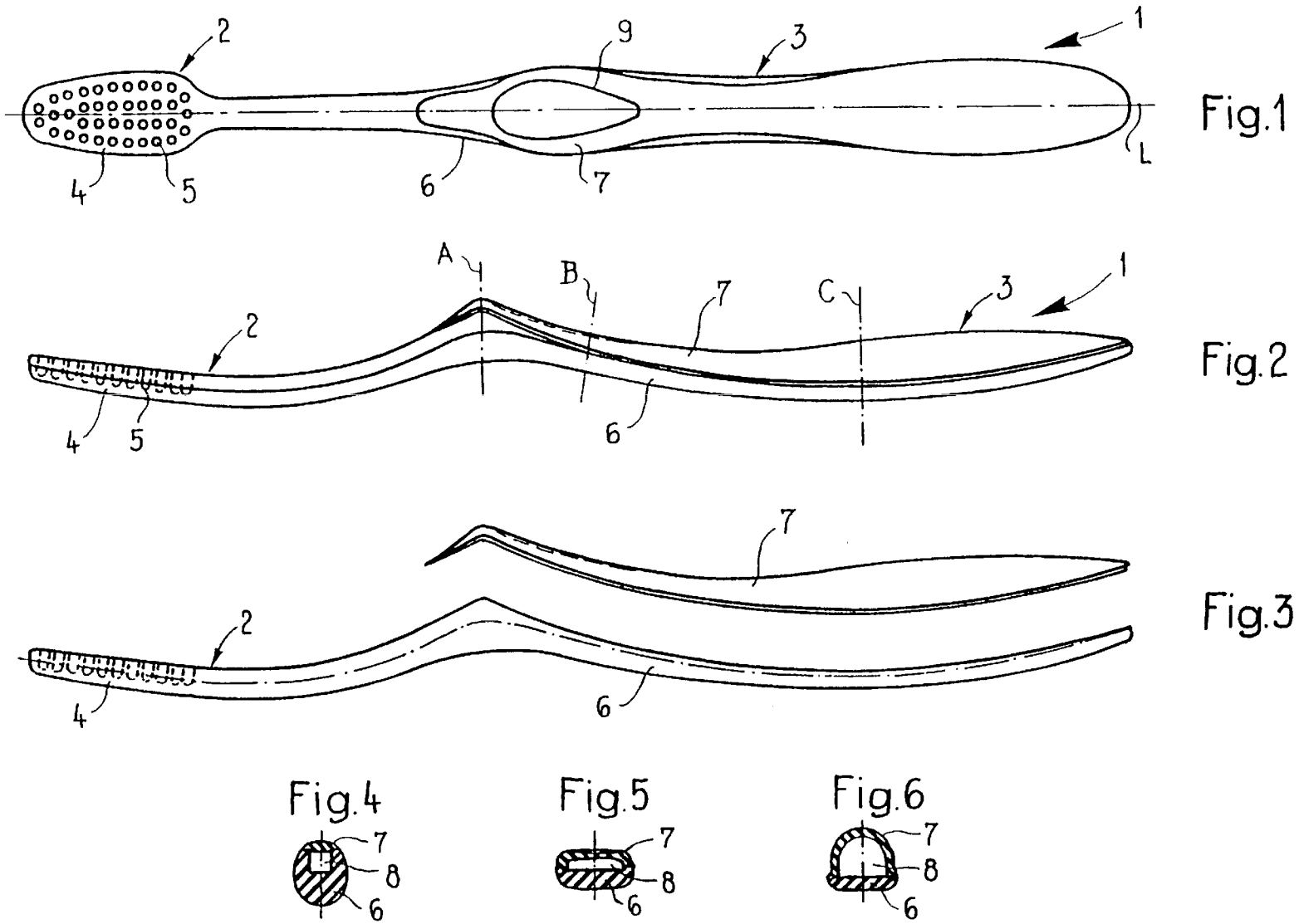
FIG. 1 shows a plan view of a first exemplary embodiment of a toothbrush.
FIG. 2 shows the toothbrush according to FIG. 1 in elevation.
FIG. 3 shows, in elevation, two toothbrush parts separated from one another.
FIG. 4 shows a handle cross section of the toothbrush along plane A according to FIG. 2.
FIG. 5 shows a handle cross section of the toothbrush along plane B according to FIG. 2.
FIG. 6 shows a handle cross section of the toothbrush along plane C according to FIG. 2.

According to FIGS. 1 and 2, a manual toothbrush 1, of which the longitudinal axis is designated L in FIG. 1, has a front bristle-carrying head part 2 and a rear handle 3. Of the head part 2, FIGS. 1 and 2 merely show a bristle carrier 4, which is provided with a number of indentations 5 which are provided for anchoring clusters of bristles in a manner known per se.

The handle 3 is subdivided, over at least part of its length, into two parts 6, 7 which extend in the longitudinal direction of the toothbrush. The bottom part 6 of the handle 3 is connected, if appropriate, to the head part 2 or formed integrally with the bristle carrier 4. The second part of the handle 3 is formed by a top cover part 7. However, instead of the bottom part 6, it would also be possible for the top handle part 7 to be configured integrally with the bristle carrier.

The top cover part 7 is preferably provided with an indentation 9 which forms a thumb rest. The two handle parts 6, 7, which are illustrated individually in FIG. 3, are connected, preferably welded, to one another, the two parts 6, 7 enclosing a cavity 8 which extends in the longitudinal direction of the toothbrush 1 (see FIGS. 4, 5 and 6). For this purpose, at least one of the two parts 6, 7 has a shell-like cross section.

FIGS. 1 to 6 illustrate a possible, aesthetically pleasing configuration of the handle 3 in which the cavity 8 extends virtually over the entire handle length. Some other form would, however, be just as possible.

The handle 3 according to the invention, which is subdivided, over at least part of its length, into two parts 6, 7 which enclose a cavity 8, may be of relatively wide configuration, which results in a better grip without the toothbrush becoming too unwieldy. The grip may additionally be improved by the selection of a suitable material for the two parts 6, 7. It is also possible for the bottom part 6 and the cover part 7 to be produced from different materials. For example, the bottom part 6 may be made of a harder material than the cover part 7. For better handling, the cover part 7 or the bottom part 6 may be produced wholly or partially from an elastically compliant material. In this case, it is also possible for the cavity 8 to be filled with an elastic material.

It is also possible for the two handle parts 6, 7 to be produced from materials which look different (for example different colors for the two parts, it being possible for the materials to be the same or different). It is also possible for one or both parts to be partially or wholly transparent or translucent.

If at least one of the two handle parts 6, 7 is produced from a transparent material, then the cavity 8 may be filled with decorative objects or playthings, e.g. snowflakes or figures. It is also possible, however, for the cavity 8 to be filled with a liquid which may also contain, for example, floating objects (of course, sealing of the cavity 8 is then imperative, this taking place in a manner described hereinbelow).

The cavity 8 may also be filled with a gas.

It is also possible for the cover part 7 to be of transparent design and for that surface of the bottom part 6 which is visible from above to be provided, e.g. printed, with an image or text.

In order to increase the weight of the handle 3, it is also possible for the cavity 8 to contain a metal filling.

The cover part 7, but also the bottom part 6, may advantageously be produced from a multi-component material, for example by injecting molding. This solution, rather than just providing possible decorative means in order to improve the aesthetics, also makes it possible to optimize the elasticity properties which are important for a better grip.

FIGS. 7 to 10 illustrate a further exemplary embodiment of a manual toothbrush 1' of which the handle 3, in turn, comprises a bottom part 6 and a top cover part 7. In this variant, the indentation 9 provided for the thumb rest is preferably filled with a soft thermoplastic elastomer. At the same time, in this region, the top cover part 7 is provided with one or more, preferably with six, downwardly directed protuberances 11 which, when the two handle parts 6, 7 are joined together, are pressed into corresponding openings 12 of the bottom part 6, project through the latter with sealing action in the end position according to FIG. 8, and project to a slight extent on the bottom outer side. The protuberances 11, which preferably consist of rubber-like, soft elastomer, serve, together with the soft thumb rest, for improving the grip.

Figures 7, 8, 9, 10:
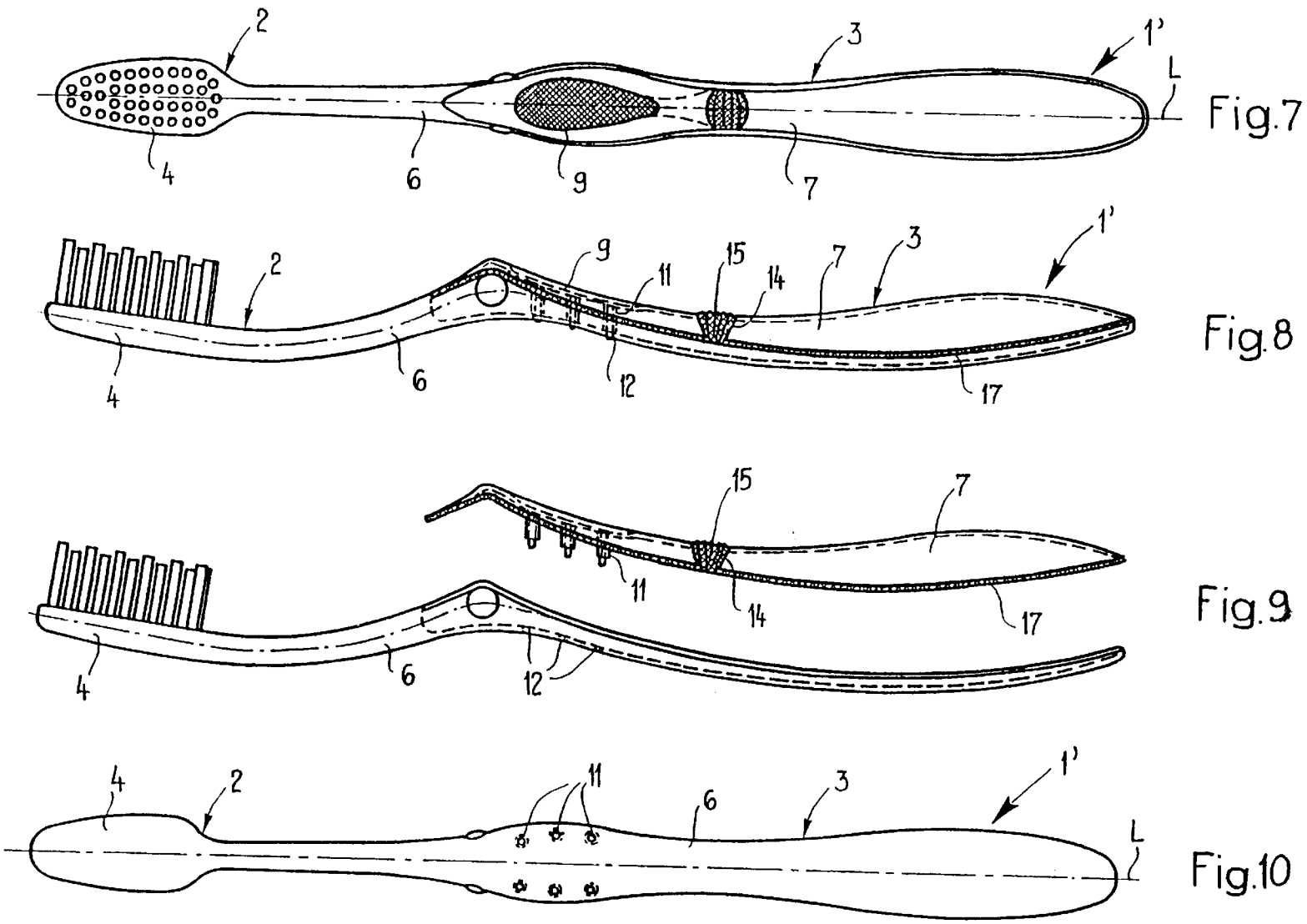
FIG. 7 shows a plan view of a second exemplary embodiment of a toothbrush.
FIG. 8 shows the toothbrush according to FIG. 7 in elevation.
FIG. 9 shows, in elevation, two toothbrush parts separated from one another.
FIG. 10 shows a bottom view of the toothbrush according to FIG. 7.

Instead of a plurality of protuberances 11 on one of the two handles 7 or 6 and a plurality of openings 12 in the other part 6 or 7, it would be possible to provide on one part 7 or 6, for example in the region of the thumb rest, a single protuberance or peg, of which the cross section is, for example, in the droplet form of the indentation 9 according to FIG. 7 and projects into a hole of the same cross section in the other part 7 or 6 and extends to the outer side of the same.

It is also possible, however, for at least one of the two handle parts 6, 7 to be provided with a hole (for example of the droplet cross section in the form of the indentation 9 according to FIG. 7) which opens out into the cavity 8 and is preferably sealed off by a membrane made of rubber-like material. In this case, the handle, in the plane designated B in FIG. 2, is, for example, of the cross-sectional form illustrated in FIG. 11. In this exemplary embodiment, a hole 10 is provided in the top cover part 7, and the cavity 8 is closed off by a membrane 13 which—in a manner similar to the abovedescribed protuberances or pegs—contributes to the ease of handling. The membrane 13 also gives rise to improved elasticity. The material of the membrane and the dimensions of the latter have a critical effect on the flexibility of the handle.

As can be seen from FIGS. 7 to 9, the elasticity of the top cover part 7 can be improved in that a wedge-shaped recess 14 running transversely to the longitudinal axis L is formed in said part 7 and is filled with a rubber-like material, for example a thermoplastic elastomer, as a result of which a type of joint is produced (designated 15 in FIGS. 7 to 9).

As has already been mentioned, the two handle parts 6, 7 are preferably welded to one another along the lines of contact, the cavity 8 being sealed along the welding lines. The outer edge produced by overlapping during the welding operation may be covered over by a rubber skin, which not only provides additional sealing, but also improves hygiene since impurities cannot accumulate along the welding lines. It is also possible, however, for the two handle parts 6, 7 to be joined together in the manner of a snap-in connection which preferably cannot be detached by hand, the snap-in connection likewise having a sealing action. It is thus possible, for example, for the top cover part 7 to be provided with a sealing edge 17 made of thermoplastic elastomer, as is illustrated in FIGS. 8 and 9. It is also possible, however, for the two handle parts 6, 7 to be connected by adhesive bonding.

FIGS. 12 to 15 show a variant in which the cavity 8 can be reliably sealed at all locations by welding, even if one of the two handle parts 6, 7 has provided on it the protuberances 11 or pegs which project through the cavity 8 and the other handle part 7, 6 and are made of soft material, for example an elastically compliant thermoplastic elastomer.

In this variant, the top cover part 7 is provided, in its rear region, with a downwardly directed, sleeve-like protrusion 20 which extends in the longitudinal direction of the handle 3, has an outer wall 21 and an inner wall 22 and is of oval design in cross section. The inner wall 22 encloses an inner space which projects through the cover part 7 at right angles to the longitudinal axis of the latter and is filled with the elastically compliant material, which forms a grip pad 24. The cover part 7, which is provided with the protrusion 20, and the grip pad 24 are produced, for example, by multi-component injection molding. The grip pad 24 has a top grip surface 25 and a bottom grip surface 26.

The bottom part 6 is provided with an opening 27 which corresponds, in cross section, to the outer form or the outer wall 21 of the protrusion 20.

When the two handle parts 6, 7 are welded together, the protrusion 20, which is introduced into the opening 27 and is filled with the grip pad 24 made of softer material, is also welded to the bottom part 6, as a result of which the cavity 8 is also sealed at this location.

Figures 11, 12, 13, 14, 15:
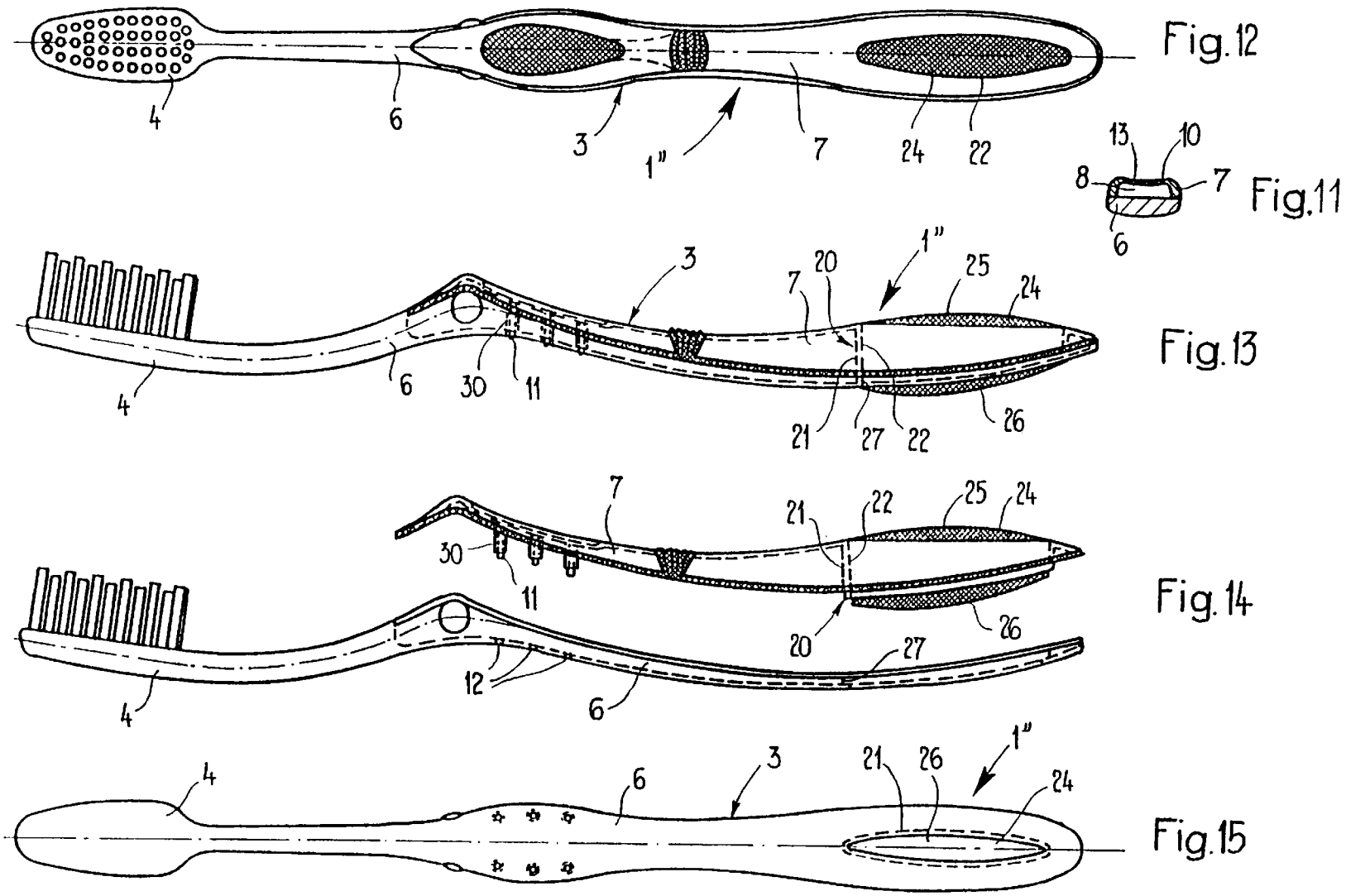
FIG. 11 shows a further possible handle cross section of the toothbrush along plane B according to FIG. 2.
FIG. 12 shows a plan view of a third exemplary embodiment of a toothbrush.
FIG. 13 shows the toothbrush according to FIG. 12 in elevation.
FIG. 14 shows, in elevation, two toothbrush parts separated from one another.
FIG. 15 shows a bottom view of the toothbrush according to FIG. 12.

As can be seen from FIG. 13, the two grip surfaces 25, 26 are adapted in aesthetic terms to the outer form of the handle 3.

In a similar manner to the grip pad 24, it is also possible for the protuberances 11, which are already known from FIGS. 8 and 9 and are made of soft material, to be accommodated in corresponding sleeve-like protusions 30 (see FIG. 14) of one handle part 7, said protrusions being inserted into associated openings 12 of the other handle part 6 and being welded to the latter, as a result of which sealing of the cavity 8 is also ensured here.

The toothbrush according to the invention is straightforward and cost-effective to produce. The hollow form of the handle 3 means that the amount of material used is reduced. The top cover part 7 and/or the bottom part 6 may be injection molded with one, two or more components. Since the two handle parts 6, 7 are thin-walled parts, it is possible, during production by injection molding, for the time taken for the injection-molding process to be reduced.

Of course, it is also possible for the handle according to the invention to be used for types of toothbrush other than those illustrated in the drawing, e.g. for toothbrushes of which the head part is provided with one or two exchangeable brush heads.

What is claimed is:

1. A toothbrush having a bristle-carrying head part and a handle, the handle being subdivided, over at least part of its length, into two parts which extend in the longitudinal direction of the toothbrush, are connected to one another and, together, enclose a cavity, wherein at least one of the two handle parts consists at least partially of an elastically compliant material located adjacent the cavity to partially define the cavity.

2. The toothbrush as claimed in claim 1, wherein the handle has a bottom part, which is connected to the head part, and a top cover part, at least one of the two handle parts being shell-like.

3. The toothbrush as claimed in claim 2, wherein the top cover part and/or the bottom part are/is produced by multi-component injection molding.

4. The toothbrush as claimed in claim 2, wherein the top cover part is at least partially transparent and that surface of the bottom part which is visible from above is provided with an image or text.

5. The toothbrush as claimed in claim 1, wherein the handle has a top cover part, which is connected to the head part, and a bottom part, at least one of the two handle parts being shell-like.

6. The toothbrush as claimed in claim 1, wherein the two handle parts are produced from different materials.

7. The toothbrush as claimed in claim 1, wherein the two handle parts look different from one another.

8. The toothbrush as claimed in claim 1, wherein the cavity is filled with an elastic material.

9. The toothbrush as claimed in claim 1, wherein at least one of the two handle parts is at least partially transparent.

10. The toothbrush as claimed in claim 9, wherein the cavity, which is enclosed by the two handle parts, is filled with objects such as snowflakes, figures or other playthings.

11. The toothbrush as claimed in claim 9, wherein the cavity, which is enclosed by the two handle parts, is filled with a liquid preferably containing floating objects.

12. The toothbrush as claimed in claim 1, wherein the cavity, which is enclosed by the two handle parts, is sealed off at the connecting location of the two parts.

13. The toothbrush as claimed in claim 12, wherein the cavity, which is enclosed by the two handle parts, is filled with a gas.

14. The toothbrush as claimed in claim 1, wherein the two handle parts are welded to one another, the outer edge produced during the welding operation preferably being covered wholly or partially with elastic rubber material.

15. The toothbrush as claimed in claim 1, wherein the two handle parts are connected to one another in the manner of a snap-in connection which preferably cannot be detached by hand.

16. The toothbrush as claimed in claim 15, wherein one of the two handle parts is provided with a sealing edge preferably made of a thermoplastic elastomer.

17. The toothbrush as claimed in claim 1, wherein the cavity, which is enclosed by the two handle parts, extends essentially over the entire handle length.

18. The toothbrush as claimed in claim 1, wherein one of the two handle parts is provided with an indentation which serves as a thumb rest and is filled with an elastically compliant material, preferably an elastomer.

19. The toothbrush as claimed in claim 1, wherein one of the two handle parts is provided with at least one, preferably more than one, protuberance, and the protuberances project with sealing action through associated openings in the other part.

20. The toothbrush as claimed in claim 1, wherein at least one of the two handle parts is provided with a hole which opens out into the cavity and is closed in the outward direction by a membrane made of elastically compliant material, preferably in a sealing matter.

21. The toothbrush as claimed in claim 1, wherein a wedge-shaped recess running transversely to the longitudinal direction of the toothbrush is formed in one of the two handle parts and is filled with an elastically compliant material.

22. A toothbrush having a bristle-carrying head part and a handle, the handle being subdivided, over at least part of its length, into two parts which extend in the longitudinal direction of the toothbrush, are connected to one another and, together, enclose a cavity, wherein at least one of the two handle parts consists at least partially of an elastically compliant material, wherein one of the two handle parts is provided with at least one, preferably more than one, sleeve-like protrusion, the protrusions being arranged transversely to the longitudinal direction of the toothbrush, being filled with an elastically compliant material, projecting through associated openings in the other part and being welded to the latter.

23. The toothbrush as claimed in claim 22, wherein at least one of the protrusions has an inner wall which encloses an inner space which projects through the handle and is filled with the elastically compliant material, which forms a grip pad.

24. A toothbrush having a bristle-carrying head part and a handle, the handle being subdivided, over at least part of its length, into two parts which extend in the longitudinal direction of the toothbrush, are connected to one another and, together, enclose a cavity, wherein at least one of the two handle parts consists over at least a part of its longitudinal length of an elastically compliant material located adjacent the cavity to define a portion of the cavity.

* * * * *